US005440319A

United States Patent [19]

Raymond et al.

[11] Patent Number: 5,440,319

[45] Date of Patent: Aug. 8, 1995

[54] INTEGRATED MICROWAVE ANTENNA/DOWNCONVERTER

[75] Inventors: Joel J. Raymond, Port Hueneme; Lawrence G. Crawford, Camarillo, both of Calif.

[73] Assignee: California Amplifier, Camarillo, Calif.

[21] Appl. No.: 131,081

[22] Filed: Oct. 1, 1993

[51] Int. Cl.[6] ..... H01Q 1/12

[52] U.S. Cl. ..... 343/833; 343/834; 343/882

[58] Field of Search ..... 343/833, 789, 834, 878, 343/785, 895, 880, 756, 882, 715, 818, 819, 869, 837; 248/74.1, 316.1; H01Q 1/12

[56] References Cited

U.S. PATENT DOCUMENTS

| | | | |
|---|---|---|---|
| 3,245,642 | 4/1966 | Dicke | 343/878 |
| 4,295,141 | 10/1981 | Bogner | 343/785 X |
| 4,356,493 | 10/1982 | Bogner | 343/785 X |
| 4,819,006 | 4/1989 | Whitesides et al. | 343/880 |
| 5,055,852 | 10/1991 | Dusseux et al. | 343/769 X |

FOREIGN PATENT DOCUMENTS

| | | | |
|---|---|---|---|
| 1266371 | 4/1968 | Germany | 343/882 |
| 2120856 | 12/1983 | United Kingdom | 343/757 |

*Primary Examiner*—Donald Hajec
*Assistant Examiner*—Tho G. Phan
*Attorney, Agent, or Firm*—Freilich, Hornbaker Rosen

[57] ABSTRACT

An antenna/downconverter directed to the subscription television distribution industry. The antenna/-downconverter (20) includes an integral multidisc director mounted to a housing (51) which defines a reflector cup (54), side lobe suppression ears (38) and a chamber (66) which provides environmental protection for downconverter electronics (184). Received microwave energy is coupled to the downconverter electronics from the perimeter of a receive disc (50) axially spaced from the reflector cup. The housing defines a plurality of jaws (36) which facilitate alignment to variously polarized microwave signals when an installer receives a mounting mast in a selected one of the jaws.

19 Claims, 6 Drawing Sheets

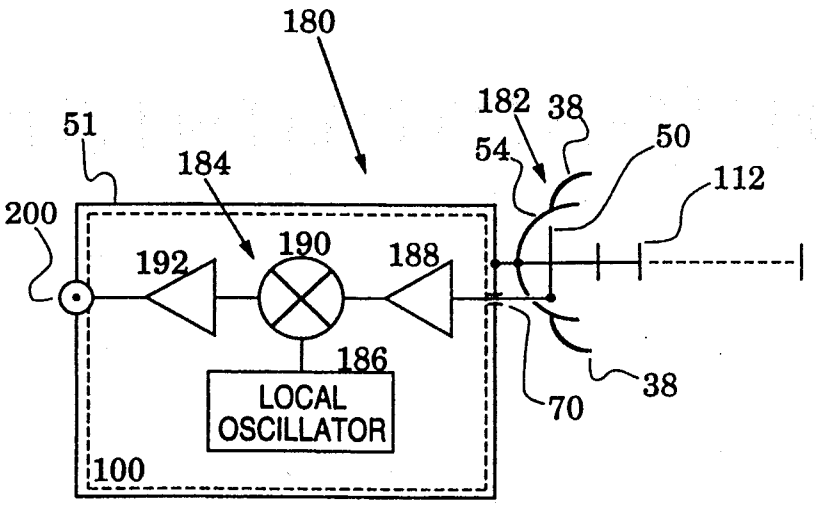
FIG. 12
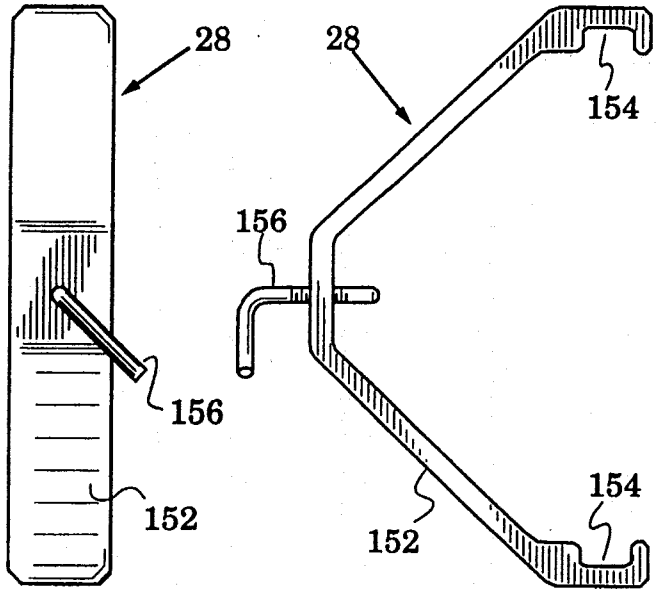
FIG. 11
FIG. 10

INTEGRATED MICROWAVE ANTENNA/DOWNCONVERTER

FIELD OF THE INVENTION

The present invention relates to antenna/downconverters suitable for use by television subscribers in receiving variously polarized microwave signals.

BACKGROUND OF THE INVENTION

Subscription television service is typically provided by cable systems and "wireless TV" over-the-air systems. Wireless TV systems generally transmit the TV signals at microwave frequencies (e.g., in the 2500–2686 MHz band reserved for the Multichannel Multipoint Distribution System) from a "head end" distribution point and provide each subscriber with an antenna and downconverter to access the signal from the head end. The antenna is mounted at each subscriber location and directed towards the head end. To reduce added noise due to long signal paths, the downconverter is sometimes combined with the antenna.

A prior integrated microwave antenna/downconverter which has been offered by California Amplifier, Camarillo, Calif. (part numbers 31545-12, -15 and -18) uses a Yagi type antenna with a downconverter in a separate housing attached to the back of the antenna. The antenna includes a plurality of separate director discs assembled in an axially spaced relationship on a rod which mounts to a backplane member defining a reflector and planar side lobe suppression ears. A receive disc is spaced from the reflector and energy is coupled from the receive disc perimeter with a coaxial cable which is looped to the downconverter. A cup shaped dielectric member provides environmental protection for the receive disc. The combined antenna and downconverter is mounted to a mast with a clamp.

Other related antenna structures are disclosed in U.S. Pat. Nos. 3,440,658; 4,054,874; 4,118,706 and 4,295,141.

SUMMARY OF THE INVENTION

The present invention is directed to antenna/downconverters particularly suited for use by subscription television subscribers in receiving variously polarized microwave signals.

Preferred embodiments of the invention are characterized by a housing having transversely spaced arcuate ears extending from a first face, an integral director carried by the first face and comprised of a plurality of axially spaced discs including a terminal director disc located proximate to said first face, a receive structure proximate to said terminal director disc, and a plurality of circumferentially spaced mounting jaws formed on a housing second face with each configured to engage a support mast.

In accordance with an important feature of the preferred embodiment, each of the mounting jaws are located to align the receive structure with a selected one of the polarized microwave signals. They are preferably grouped in radially spaced pairs to more effectively grip the support mast. A stop is defined by the housing second face to locate a clamp thereon for enclosing the support mast with any of the jaws.

In a preferred embodiment, the receive structure includes a reflector cup formed on the housing first face and a receive disc carried therein. Downconverter electronics is preferably carried within the housing and coupled to the receive structure.

The housing and director discs are preferably each configured as integral pieces for economical fabrication and assembly.

The novel features of the invention are set forth with particularity in the appended claims. The invention will be best understood from the following description when read in conjunction with the accompanying drawings.

BRIEF DESCRIPTION OF DRAWINGS

FIG. 10 is a rear elevation view of the clamp of FIG. 1;

FIG. 11 is a side elevation view of the clamp of FIG. 10;

FIG. 12 is a block diagram of the antenna/downconverter of FIG. 1; and

DESCRIPTION OF THE PREFERRED EMBODIMENTS

Figure 1:
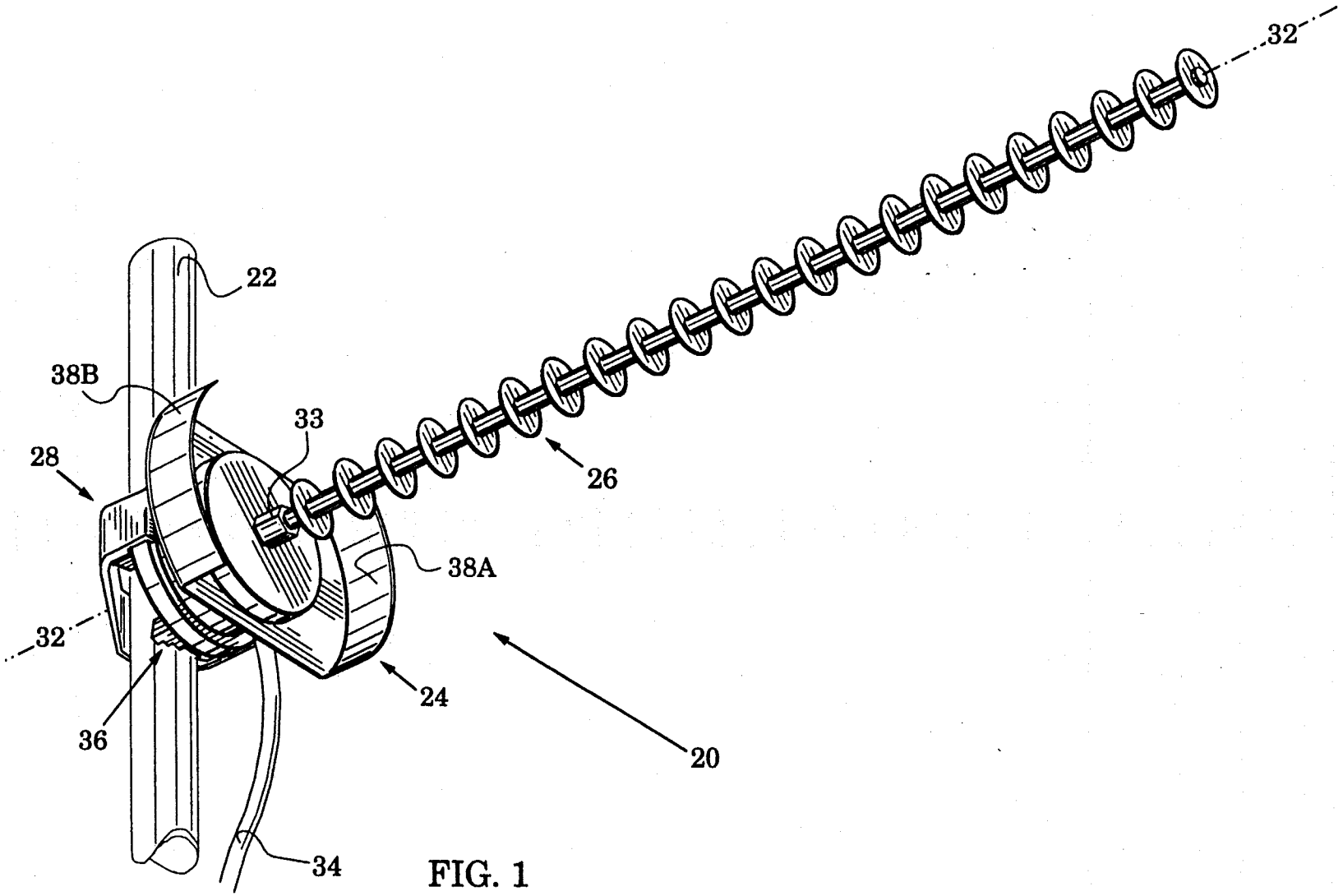
FIG. 1 is an isometric view of a preferred antenna/-downconverter embodiment in accordance with the present invention.

A preferred embodiment of an integrated microwave antenna/downconverter 20, in accordance with the present invention, is illustrated in the isometric view of FIG. I mounted to a vertically oriented mast 22 in the form of a cylindrical tube. To facilitate handling and installation, the antenna/downconverter 20 is preferably configured as three separate items; i.e., a housing assembly 24, a director 26 and a clamp 28.

The housing assembly 24 and clamp 28 are configured to cooperatively receive and grip the mast 22 for selectively supporting the antenna/downconverter to receive signals having vertical and horizontal polarization. The director 26 defines an antenna axis 32 and is supported by a nut 33 mounted on a first face of the housing assembly 24. The director 26 is configured to provide high directivity while its slender profile reduces wind and ice loading compared to many alternative antenna configurations, e.g. parabolic antennas. Arcuate side lobe suppression ears 38 are carried by the housing assembly 24 to reduce off-axis signals and increase on-axis gain.

The housing assembly 24 includes a mounting jaw system 36 arranged to selectively physically orient the housing assembly on the mast 22 in alignment with the microwave signal polarization. The housing assembly 24 also provides stops to assist positioning the clamp 28 for each housing assembly orientation. These features facilitate mounting of the antenna/downconverter 20 by a single installer. A single coaxial drop cable 34 delivers the downconverted signal to receivers located below while its center conductor provides an upward path for DC voltage to power the downconverter electronics.

In addition to its simple installation, the antenna/-downconverter 20 is configured to reduce its fabrication and assembly time. For example, the director 26 and main parts of the housing assembly 24 can be cast as integral pieces and installation of the downconverter electronics requires few steps other than a few soldering operations.

Attention is now directed to details of the antenna/-downconverter 20. A number of structural details of the embodiment 20 describe cylindrical paths about the axis 32 shown in FIG. 1. Accordingly, the following description will make use of spatial adjectives axial, radial, and circumferential in referring to directions respectively along the axis 32, away from the axis 32 and circumferentially about the axis 32.

Figures 2, 4:
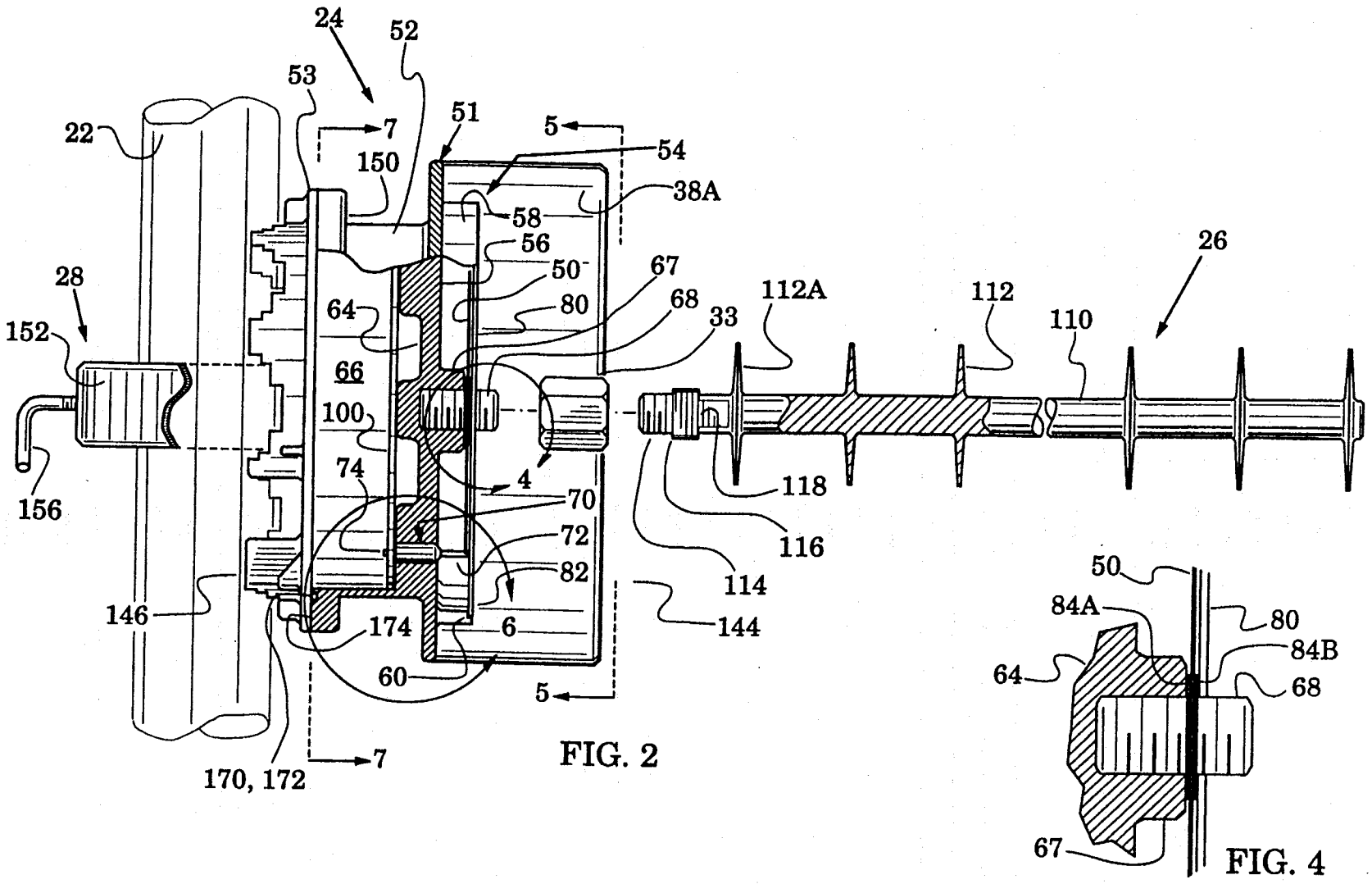
FIG. 2 is a partially exploded side view of the antenna/downconverter of FIG. 1.
FIG. 4 is an enlarged view of the structure within the arcuate line 4 of FIG. 2.
Figure 3:
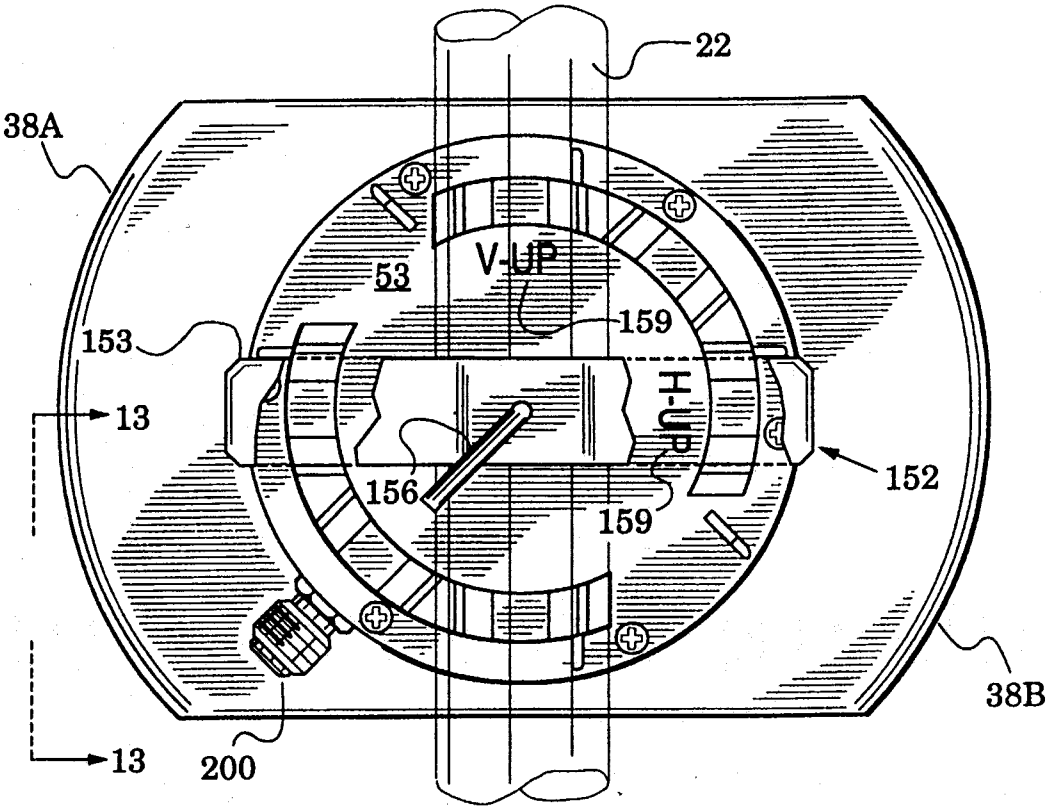
FIG. 3 is a rear elevation view of the antenna/downconverter of FIG. 1.
Figure 5:
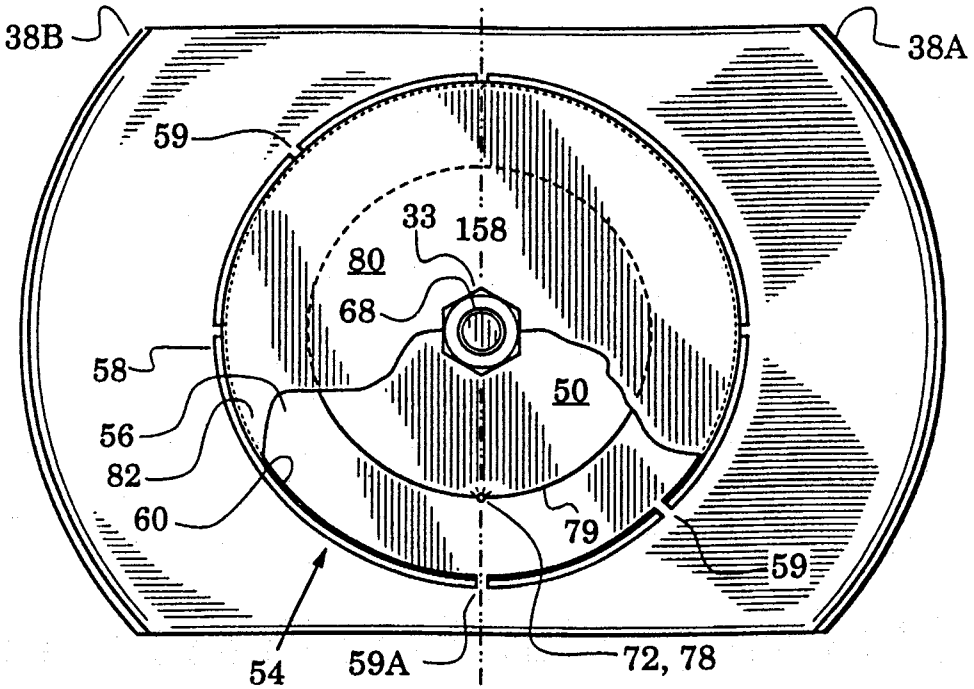
FIG. 5 is a view along the plane 5—5 of FIG. 2.

FIGS. 2 and 3 are respectively side elevation and rear elevation views of the antenna/downconverter 20 and FIG. 5 is a view along the plane 5—5 of FIG. 2. These views show the housing assembly 24 to include a housing 51 preferably formed of a body 52 and a cover 53. The housing body 52 defines a reflector cup 54 having a back 56 and an annular rim 58. The annular rim 58 is interrupted by radial drain slots 59 and defines an annular step 60 at the top edge of its inner side. The housing body 52 has a transverse web 64 which separates the reflector cup 54 from a chamber 66. This transverse web 64 defines, in the center of the reflector cup, a forward directed boss 67 which receives a threaded stud 68. An insulated feedthrough 70 projects axially through the web 64 so that a first end 72 is available in the reflector cup 54 and a second end 74 is available in the chamber 66.

Figure 6:
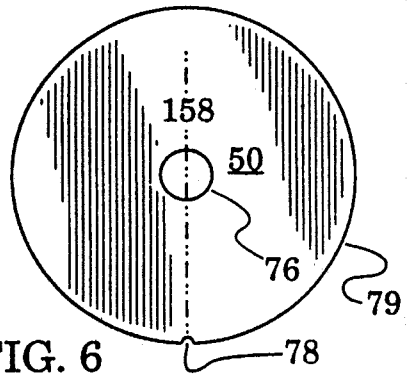
FIG. 6 is a view of the receive disc of FIG. 5.

A receive disc 50 is preferably fabricated from a low loss material, e.g., tin plated (to facilitate soldering assembly and enhance corrosion resistance) copper sheet and, as shown separately in FIG. 6, defines a hole 76 at its center and a circular indentation 78 in its perimeter 79. The receive disc 50 is mounted over the stud 68 with its indentation 78 receiving the feedthrough first end 72. Thus the feedthrough first end 72 is positioned to receive energy from the voltages developed in the receive disc 50. A fiat dielectric wafer 80 functions as a radome. The wafer has a center hole which receives the stud 68 while the perimeter 82 of the wafer is received into the annular step 60 formed in the periphery of the reflector cup 54. FIG. 4 is an enlarged view of the structure within the arcuate line 4 of FIG. 2 which shows a pair of conductive washers 84A, 84B installed on each side of the receive disc 50. The nut 33 is threaded onto the stud 68 to secure the receive disc 50, washers 84 and wafer 80 on the housing body 52.

Figure 7:
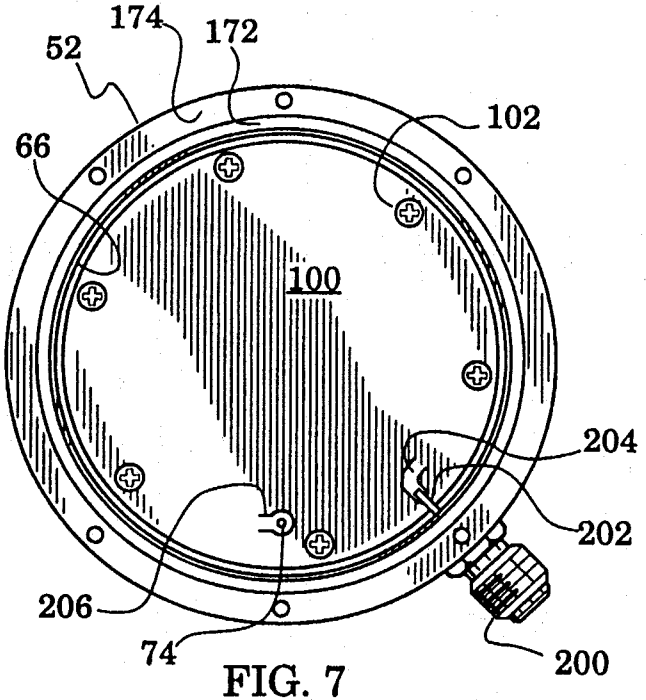
FIG. 7 is view along the plane 7—7 of FIG. 2.

Downconverter electronics are carried on a microstrip circuit board 100 shown in FIGS. 2 and 7 (FIG. 7 is a view along the plane 7—7 of FIG. 2). In the antenna/downconverter embodiment 20, the microstrip board 100 defines a circular shape for reception into the chamber 66 and is secured to the web 64 with standard hardware 102. The first and second ends 72, 74 of the feedthrough 70 are soldered respectively to the receive disc 50 and the microstrip board 100 to effect a short, low loss path therebetween. The downconverter input impedance, e.g., 50 ohms, is closely matched by the feedthrough impedance to reduce reflection losses.

Attention is now directed to details of the integral director 26 as shown in FIG. 2. The director has a central rod 110 which defines axially spaced director discs 112 including and terminating in a terminal director disc 112A. The end 114 of the rod 110 adjacent to the terminal director disc 112A is threaded to mate with the nut 33. A stop 116 abuts the nut 33 to set the spacing between the receive disc 50 and the terminal director disc 112A when the stud 68, nut 33 and director 26 are fully engaged as in FIG. 1 (FIG. 2 illustrates these three parts in an axially exploded position). Along the sides of the stop 116, the rod 110 defines a pair of fiats 118 to facilitate use of a tool, e.g., a wrench, in installing the director 26 into the nut 33.

Figure 9:
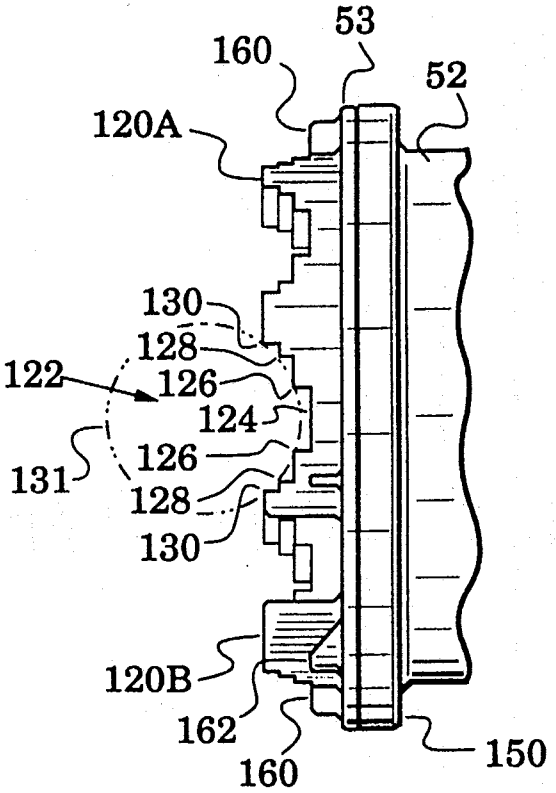
FIG. 9 is a side view of the housing cover of FIG. 8.
Figure 8:
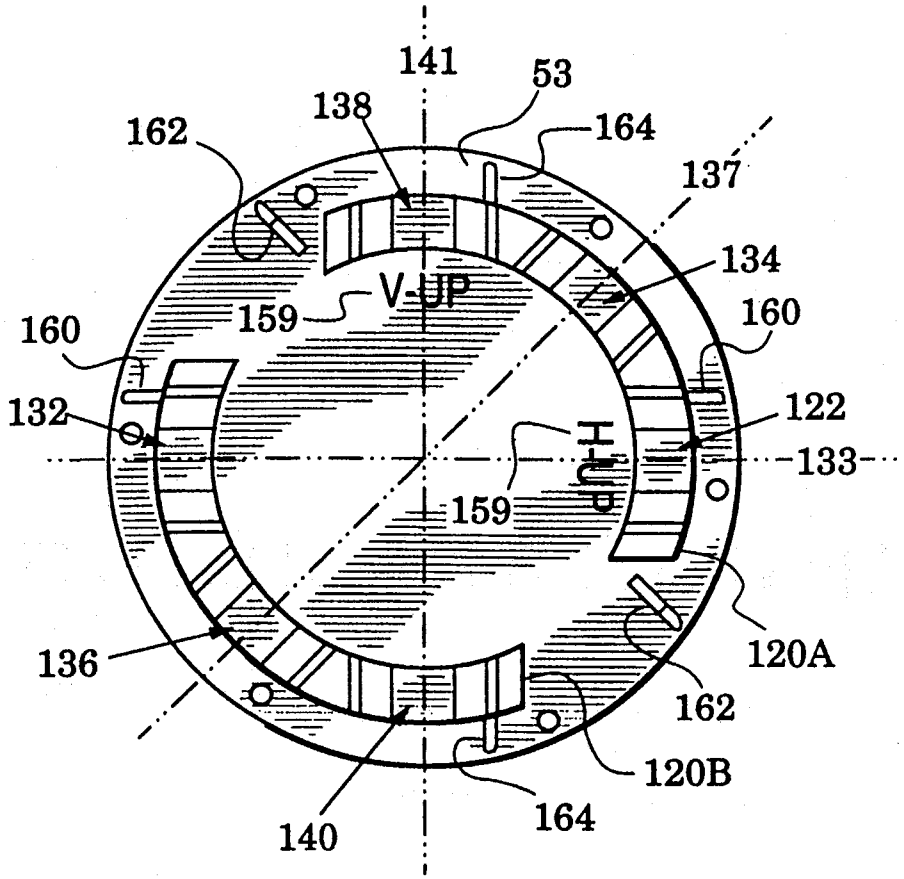
FIG. 8 is a view of the housing cover of FIG. 3.

FIG. 8 is a separate view of the housing cover 53 of FIG. 3 and FIG. 9 is a side view of the cover with a portion of the housing body 52 attached. These views illustrate details of the jaw system 36 referred to above relative to FIG. 1. The integral housing cover 53 defines a pair of radially spaced arcuate bosses 120A, 120B. In FIG. 9, a jaw 122 is formed in the boss 120A by a depressed step 124 located between pairs of ascending steps. The step intersections thus form ridges 126, 128 and 130 arranged to engage various sized masts. For illustrative purposes, the ridges 126, 128, 130 are shown to abut a mast 131 (rotated 90 degrees from the mast 22 of FIGS. 1–3) while a smaller diameter mast may a abut only ridges 126 and a larger diameter mast may abut only ridges 130. FIG. 8 shows the jaw 122 and a similar but radially spaced jaw 132 formed in the boss 120B. The jaws 122, 132 are diametrically opposed and, together, form a first jaw pair 122, 132 aligned along the centerline 133.

In a similar way, the bosses 120A, 120B form a second jaw pair 134, 136 aligned along the centerline 137 and a third jaw pair 138, 140 aligned along the centerline 141. The centerlines 137 and 141 are respectively rotated 45 degrees and 90 degrees from the centerline 136. The jaw pairs are thus circumferentially spaced 45 degrees and configured to receive the mast 22 to position the housing assembly 24 in a selected one of three circumferentially spaced relationships with the mast. Therefore, as shown in FIG. 2, it is apparent that the arcuate ears 38 and reflector cup 54 are defined in a first exterior face 144 of the housing 51 and the jaw system 36 is defined in a second axially spaced exterior face 146 of the housing 51.

FIGS. 10 and 11 are respectively rear and side views of the clamp 28. FIGS. 2 and 9 show an annular step 150 defined on the housing body 52. The clamp 28 includes a yoke 152 (broken away for clarity of illustration in FIGS. 2, 3) which forms diametrically opposed grooves 154 to slidingly receive the step 150 and allow the yoke to embrace the mast 22 between itself and the housing cover 53. The clamp 28 also includes a clamp screw 156 that is threaded through the yoke 152 to compressingly abut the mast 22.

Preferably, the imaginary line 158 shown in FIGS. 5 and 6 to be midway between the ears 38A, 38B and to pass through the disc center hole 76 and the disc indentation 78 should be aligned or oriented with the electrical field polarity of the incoming microwave signal. Thus, if the signal is horizontally polarized, the imaginary line 158 should also be horizontal when the housing assembly 24 is installed on the mast 22. This is realized by receiving the mast 22 in the first jaw pair 122, 132 of FIG. 8.

When the mast 22 is received in the third jaw pair 138, 140, the antenna/downconverter 20 will be aligned with vertically polarized signals. When the mast 22 is received in the second jaw pair 134, 136, the antenna/-downconverter 20 will be oriented at a 45 degree angle with both vertically and horizontally polarized signals.

As shown in FIGS. 3, 8, indicia 159 are cast into the housing cover 53 to aid the installer in aligning with the desired electric field. For example, if the installer wishes to align the antenna/downconverter 20 with a vertically polarized microwave signal, he rotates the housing assembly 24 until the indicia "V-UP" is at the upper side of the housing cover 53 as in FIG. 3.

As shown in FIGS. 8, 9, the housing cover 53 defines a pair of stops 160, each extending radially outward from one of the bosses 120. In FIG. 3, the yoke 152 may be slid upward to firstly engage the step 150 (see FIG. 2) with the yoke grooves 154 and secondly abut the stops 160 with the upper side 153 of the yoke 152. The stops 160 thus position the yoke 152 on the housing assembly 24 while an installer is tightening the clamp screw 156 against the mast 22. With the yoke 152 prevented from sliding upward, the antenna/downconverter 20 can also be allowed to tilt downward until the yoke 152 and lower jaw 140 (see FIG. 8) abut the mast 22 to relieve most of the weight from the installer.

Second and third pairs of stops 162, 164 are defined by the housing cover 53 to cooperate in a similar manner with the yoke 152 when the mast 22 is respectively received in jaw pairs 134, 136 and 122, 132.

When the antenna/downconverter 20 is installed on a mast 22 as in FIG. 1, the cup rim 58 and dielectric wafer 80 shield the receiving disc and feedthrough end 72 from the weather. To prevent retention of moisture that might accumulate in the cup 54 (e.g., from condensation), the radial drain slots 59 are circumferentially spaced 45 degrees and positioned so that one of them is downward in each angular relationship of the antenna/-downconverter 20 and mast 22. For example, as shown in FIG. 5, the slot 59A is positioned to drain away any accumulated moisture.

As seen in FIGS. 1, 2 and 5, the diametrically opposed ears 38 extend axially from the housing first face (144 in FIG. 2), are radially spaced from the director 26 and define an arcuate shape. The arcuate shape has been found to reduce off-axis signals and increase on-axis gain relative to planar ears.

As shown in FIGS. 2 and 7, the housing body 52 and housing cover 54 are physically sealed with the aid of an O-ring 170 received in an annular groove 172 which is defined in an annular rim 174 of the housing body 52.

FIG. 12 is an electrical block diagram 180 of the microwave integrated antenna/downconverter 20. The Yagi type antenna 182 includes the receive disc 50 within the reflector cup 54, the director discs 112, and the side lobe suppression ears 38. Energy from the antenna 182 is coupled to the downconverter electronics 184 via the feedthrough 70. The downconverter electronics 184 includes a local oscillator 186 and microwave amplifier 188 which together drive a mixer 190 to produce a downconverted frequency which is amplified by an IF amplifier 192. The downconverter electronics 184 is mounted on the microstrip board 100 within an environmentally sealed housing 51.

Figure 13:
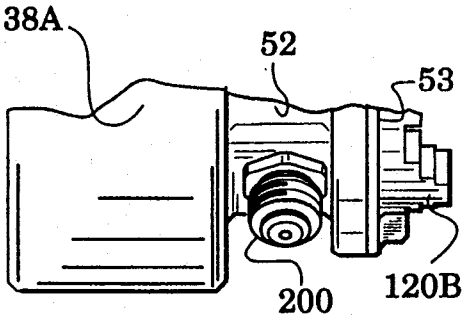
FIG. 13 is a view along the plane 13—13 of FIG. 3.

The downconverted energy is delivered through a coaxial connector 200 which is physically mounted in the housing body 52 as shown in FIG. 3 and FIG. 13 which is a view along the plane 13—13 of FIG. 3. The connector 200 preferably includes a microstrip launcher 202 which is soldered to the output track 204 of the microstrip board 100. The feedthrough second end 74 is soldered to the input track 206. The coaxial drop cable 34 of FIG. I attaches to the output connector 200. The location of the indicia 159 (seen in FIG. 3) encourages installation on the mast 22 to orient the output connector 200 generally downward to ease strain on the drop cable 34. In special installations, it may be desired to invert the antenna/downconverter 20 from these suggested relationships with the mast 22. Therefore, as oriented in FIG. 5, the cup rim 58 defines a set of three drain slots 59 in the upper right quadrant and another set in the lower left quadrant.

The director 26, housing body 52 and housing cover 53 are preferably cast as integral pieces in an electrically low loss material such as aluminum or magnesium. In these forms, an integral cast director 26 defines director discs 112, threaded end 114, stop 116, and flats 118, an integral housing body 52 defines the reflector cup 54 (including back 56, rib 58, step 60 and slots 59), side lobe suppressor ears 38 and chamber 66 and an integral housing cover 53 defines the jaw system 36 stops 160, 162 and 164, O-ring groove 172 and indicia 159. It should be understood that other embodiments of the housing may define equivalent bodies and covers having boundaries along contours other than those shown in the figures.

Specifications of an exemplary embodiment of the antenna/downconverter 20 for the input frequency band of 2500 to 2686 MHz, are provided in the attached exhibit A.

Although the preferred embodiment 20 shown in the figures defines a receive structure that includes the receive disc 50, other embodiments may employ equivalent receive structures, e.g., dipoles, waveguide feeds, with the jaw sets of FIG. 8 (e.g., jaw pairs 122, 132) located to orient each receiving structure with selected ones of differently polarized microwave signals to thereby maximize the received signal.

From the foregoing it should now be recognized that a preferred embodiment of an antenna/downconverter has been disclosed herein especially suited for reception and downconversion of variously polarized microwave signals. Embodiments in accordance with the invention facilitate low cost fabrication and installation which is of particular interest in the subscription television distribution industry.

In particular, the invention achieves integral housing parts, an integral director, direct low loss coupling between antenna and downconverter, polarization alignment assistance, installation ease, low wind and ice loading and simple environmental protection structure.

The preferred embodiment of the invention described herein is exemplary and numerous modifications, dimensional variations and rearrangements can be readily envisioned to achieve an equivalent result, all of which are intended to be embraced within the scope of the appended claims.

What is claimed is:

1. A microwave antenna suitable for use by subscription television subscribers for selectively receiving differently polarized microwave signals, comprising:

a housing defining an axis and having first and second axially spaced exterior faces;

a first arcuate side lobe suppression ear extending axially from said housing first face spaced radially outward from said axis;

a second arcuate side lobe suppression ear extending axially from said housing first face spaced diametrically from said first ear; and a director comprising a plurality of axially spaced transversely oriented discs extending along said axis from said housing first face.

2. The antenna of claim 1 further comprising means, disposed between said director and said housing first face, for receiving any selected one of said polarized microwave signals.

3. The antenna of claim 2 further including a reflector cup defined on said first face of said housing and wherein said receiving means includes a receive disc disposed within said cup.

4. The antenna of claim 2 further comprising a plurality of jaws circumferentially spaced on said housing second face, each of said jaws configured to engage a mast and located to orient said receiving means with a selected one of said polarized microwave signals.

5. The antenna of claim 4 wherein each of said jaws defines a plurality of ridges arranged to abut said mast and said jaws are arranged in diametrically opposed pairs.

6. The antenna of claim 4 further including a clamp carried by said housing to grip said mast between said clamp and a selected pair of said jaws.

7. The antenna of claim 6 further including a plurality of stops defined on said second face, each of said stops positioned to abut said clamp for retention thereof on said housing when said antenna is aligned with a different one of said polarized microwave signals.

8. The antenna of claim 3 further including a dielectric wafer disposed across said cup to enclose said receive disc.

9. An integrated microwave antenna/downconverter suitable for use by subscription television subscribers for selectively receiving differently polarized microwave signals, comprising:

a housing defining an axis and having first and second axially spaced exterior faces;

a first arcuate side lobe suppression ear extending axially from said housing first face spaced radially outward from said axis;

a second arcuate side lobe suppression ear extending axially from said housing first face spaced diametrically from said first ear;

a director comprising a plurality of axially spaced transversely oriented discs extending along said axis from said housing first face;

means, disposed between said director and said housing first face, for receiving any selected one of said polarized microwave signals; and means, carried within said housing and responsive to said receiving means, for downconverting said received microwave signal.

10. The antenna/downconverter of claim 9 further comprising a plurality of jaws circumferentially spaced on said housing second face, each of said jaws configured to engage a mast and located to orient said receiving means with a selected one of said polarized microwave signals.

11. The antenna/downconverter of claim 10 wherein each of said jaws defines a plurality of ridges arranged to abut said mast and said jaws are arranged in diametrically opposed pairs.

12. The antenna/downconverter of claim 10 further including a clamp carried by said housing to grip said mast between said clamp and a selected pair of said jaws.

13. The antenna/downconverter of claim 12 further including a plurality of stops defined on said second face, each of said stops positioned to abut said clamp for retention thereof on said housing when said antenna is aligned with a different one of said polarized microwave signals.

14. The antenna/downconverter of claim 9 further including a reflector cup defined on said first face of said housing and wherein said receiving means includes a receive disc disposed within said cup.

15. Apparatus for mounting an antenna on a mast to selectively receive differently polarized microwave signals, comprising:

a housing defining an axis and having first and second axially spaced exterior faces, said antenna extending axially from said first face;

a plurality of pairs of diametrically opposed jaws circumferentially spaced about said axis, each pair of said jaws configured to engage said mast and positioned on said housing to orient said antenna with a selected one of said polarized microwave signals; and a clamp carried by said antenna to grip said mast between said clamp and a selected pair of said jaws.

16. Apparatus of claim 15 further including a plurality of pairs of stops defined on said second face, a different pair of said stops positioned to abut said clamp for retention thereof on said housing when said antenna is aligned with a different one of said polarized microwave signals.

17. The antenna of claim 15 wherein each of said jaws defines a plurality of ridges arranged to abut said mast.

18. A method of selectively receiving differently polarized microwave signals along a receive axis, comprising the steps of:

providing a first arcuate side lobe suppression ear extending axially from a housing first face spaced radially outward from said axis;

providing a second arcuate side lobe suppression ear extending axially from a housing first face spaced diametrically from said first ear;

providing a plurality of axially spaced transversely oriented director discs extending along said axis from said housing first face; and disposing a signal receive structure between said director and said housing first face.

19. The method of claim 18 further including the step of circumferentially spacing a plurality of jaws on a second housing face radially spaced from said first face with each jaw configured to engage a mast and located to align said signal receive structure with a selected one of said microwave signals.

* * * * *